US006459415B1

(12) United States Patent
Pachal et al.

(10) Patent No.: US 6,459,415 B1
(45) Date of Patent: Oct. 1, 2002

(54) OMNI-DIRECTIONAL PLANAR ANTENNA DESIGN

(75) Inventors: Ed Pachal, St. Albert; John Sobota, Edmonton, both of (CA)

(73) Assignee: Eleven Engineering Inc., Edmonton (CA)

( * ) Notice: Subject to any disclaimer, the term of this patent is extended or adjusted under 35 U.S.C. 154(b) by 0 days.

(21) Appl. No.: 09/855,205

(22) Filed: May 14, 2001

(51) Int. Cl.[7] ..... H01Q 9/28

(52) U.S. Cl. ..... 343/795; 343/803; 343/814; 343/815

(58) Field of Search ..... 343/795, 797, 343/798, 799, 801, 802, 803, 810, 812, 813, 814, 815, 816, 817; H01Q 9/26, 9/28, 21/12

(56) References Cited

U.S. PATENT DOCUMENTS 5,173,715 A * 12/1992 Rodal et al. ..... 343/795
5,268,701 A * 12/1993 Smith ..... 343/767
5,381,272 A * 1/1995 Yarsunas ..... 343/797
5,534,882 A * 7/1996 Lopez ..... 343/891
5,592,182 A * 1/1997 Yao et al. ..... 343/742
5,724,051 A * 3/1998 Mailandt et al. ..... 343/795
6,211,840 B1 * 4/2001 Wood et al. ..... 343/793

* cited by examiner

*Primary Examiner*—Tho Phan
(74) *Attorney, Agent, or Firm*—Alan J. Atkinson

(57) ABSTRACT

An omni-directional, planar folded dipole antenna and related quadrature phase shifter implemented on printed circuit boards (PCBs) having differing properties that are perpendicularly engaged. The planar antenna segment is implemented on a single-sided inexpensive PCB and a quadrature phase shifter and system electronics are implemented on more expensive multi-layer PCBs. The invention reduces cost and improves system reliability because coaxial or like connectors of varying material and installation quality are not required between a planar antenna and a quadrature phase shifter. Planar antenna transmits radio frequency signals in an omni-directional pattern and is capable of receiving signals from remote dipole antennas positioned in arbitrary physical orientations. The quadrature phase shifter provides both phase shifting functions and also converts an unbalanced radio frequency transceiver output signal into a balanced input signal to the planar antenna.

11 Claims, 6 Drawing Sheets

OMNI-DIRECTIONAL PLANAR ANTENNA DESIGN

BACKGROUND OF THE INVENTION

The invention relates to the field of omni-directional, planar folded dipole antenna systems operating in defined frequency bands. More particularly, the invention relates to an innovative, low cost omni-directional planar antenna and quadrature phase shifter implemented on separate, perpendicularly engaged printed circuit boards ("PCBs"). The invention is particularly useful for short range radio frequency applications such as gaming, consumer electronics and data communications.

Conventional phase shifters require additional electronic circuitry such as power dividers, resistors, inductors and capacitors. These components increase manufacturing cost and reduce system reliability. Consequently, the elimination or reduction of such components would be highly beneficial.

Various planar dipole antennas and antenna systems have been developed. For example, U.S. Pat. No. 3,813,674 to Sidford (1974) described a folded dipole antenna without radiator elements fed by a switched diode mechanism. U.S. Pat. No. 4,083,046 to Kaloi (1978) described a planar monomicrostrip dipole antenna formed on a single side of a dielectric material that was excited in a non-quadrature manner. U.S. Pat. Nos. 4,155,089 and 4,151,532 to Kaloi (1979) described twin electric microstrip dipole antennas consisting of thin electrically conducting patches formed on both sides of a dielectric substrate excited in a non-quadrature manner. U.S. Pat. No. 4,438,437 to Burgmyer (1984) described two monopoles mounted on one side of a PCB and feed lines connected on the opposite side. U.S. Pat. No. 4,916,457 to Foy et al. (1990) described a cross-slotted conductor fed with a quadrature signal employing a multi-layer PCB construction. U.S. Pat. No. 4,973,972 to Huang (1990) described a circularly polarized microstrip array antenna utilizing a honeycomb substrate and a teardrop shaped inter-layer coupling structure.

In other systems, Huang (1990) described a rudimentary phase shifting strip line feed integral to the antenna structure. U.S. Pat. No. 5,481,272 to Yarsunas (1996) described a circularly polarized microcell antenna employing a pair of crossed, non-microstrip dipoles fed through a single feed-line. The phase shifters were integral to the antenna feed design and the entire structure was manually bolted together. U.S. Pat. No. 5,508,710 to Wang et al. (1996) described a planar antenna having a circular folded dipole antenna. U.S. Pat. No. 5,539,414 to Keen (1996) and U.S. Pat. No. 5,821,902 to Keen (2000) described a single element folded dipole microstrip antenna fed by a coaxial cable. U.S. Pat. No. 5,592,182 to Yao et al. (1997) described a non-PCB dual-loop omni-directional antenna that was driven in phase quadrature. U.S. Pat. No. 6,057,803 to Kane et al. (2000) described hybrid combinations of planar antenna elements.

U.S. Pat. No. 5,268,701 to Smith et al. (1993) described a dual polarized antenna element composed of two perpendicular inter-locking elements where both the antenna and phase shifting sub-elements were incorporated into multiple layers of each sub-element so that the antenna and the phase shifting circuitry were both mounted on expensive sub-elements.

U.S. Pat. No. 5,628,057 to Phillips et al. (1997) described a strip line transformation network capable of interfacing between an unbalanced port and a plurality of differently phased balanced ports using variable length strip lines and interconnecting vias between layers. U.S. Pat. No. 5,832,376 to Henderson et al. (1998) shows a hybrid RF mixer/phase shifter containing both stripline and electronic components such as diodes.

Despite the variety of systems providing an antenna for use with electronic components, a need exists for an improved antenna system providing superior manufacturing and operating efficiencies.

SUMMARY OF THE INVENTION

The invention provides a planar, omni-directional antenna system for use with printed circuit boards. The system comprises a planar antenna engaged with a first printed circuit board for radiating and receiving electromagnetic signals, wherein the antenna has four quarter-wavelength, folded dipole sections organized in pairs, at least one pair of phasor passive radiator elements associated with said folded dipole sections on the planar antenna, a radio frequency transceiver, a quadrature phase shifter circuit engaged with a second printed circuit board wherein the quadruture phase shifter circuit comprises a phase shifting hybrid power divider and transformer connected to the planar antenna and the radio frequency transceiver, and at least one connector trace connecting the planar antenna, quadrature phase shifter, and radio frequency transceiver.

DESCRIPTION OF THE PREFERRED EMBODIMENTS

The invention provides an improved antenna for use with electronic components. A main planar antenna is implemented using a single layer, inexpensive PCB having microstrips on at least one surface. A quadrature phase shifter is implemented using a more expensive multi-layer PCB and can be substantially configured with strip lines implemented as PCB metallic traces incorporated on inner PCB layers and surrounded on outer PCB layers by metallic ground planes. Variable length strip lines are compactly configured and a PCB-strip-line-based, capacitively coupled hybrid power divider and phase shifter can be incorporated.

The functional elements of the planar antenna and quadrature phase shifter are implemented using strategically configured and dimensioned microstrip and strip line segments. The planar antenna system comprises entirely passive components fashioned from printed circuit board metallic segments, thereby reducing manufacturing cost and improving repeatability and reliability with regards to mass production of the antenna system.

Figure 1:
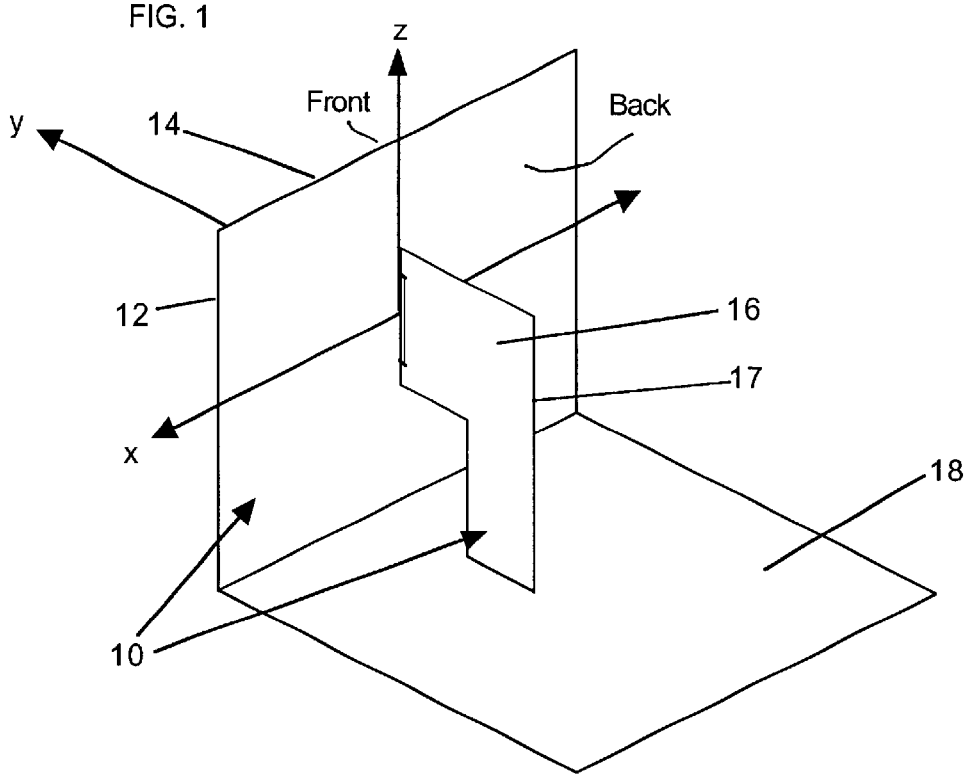
FIG. 1 illustrates the physical configuration of the invention.

As shown in FIG. 1, planar antenna system 10 is shown with PCB 12. System 10 comprises single layer planar antenna 14 implemented on PCB 12 engaged perpendicularly through a slot in the planar antenna 14 and secured by solder or similar conductive bonding material to a quadrature phase shifter 16 contained on a second multi-layer PCB 17. Second multilayer PCB 17 is more expensive than PCB 12 and may contain other system electronics such as a radio frequency transceiver. Quadrature phase shifter 16 PCB is connected to a third PCB 18 containing other system electronics such as a radio frequency transceiver.

Figure 2:
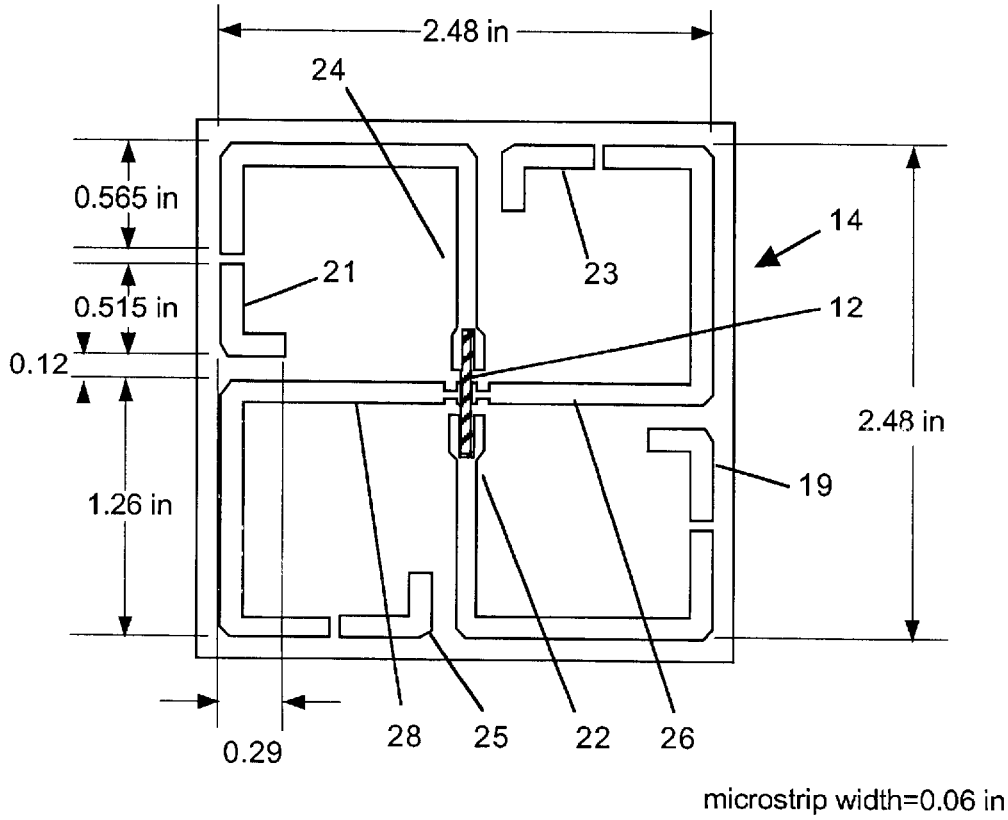
FIG. 2 illustrates the dimensioned planar antenna.
Figure 3:
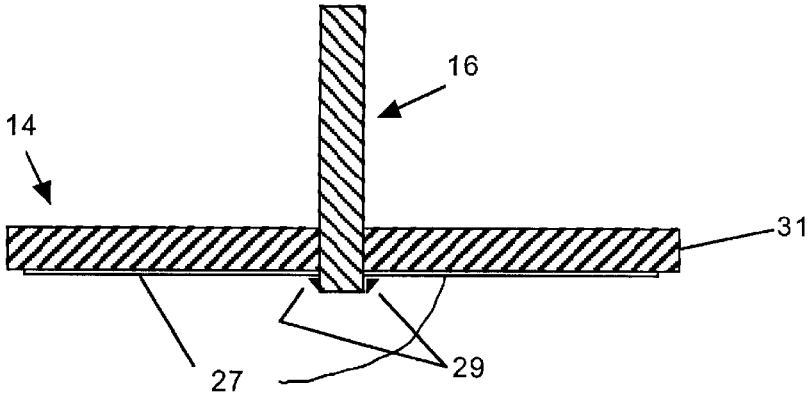
FIG. 3 illustrates a side view of the planar antenna intersecting with the quadrature phase shifter printed circuit board.

As shown in FIG. 2, planar antenna 14 consists of four folded dipole segments (22,24,26,28) where each segment is accompanied by a phasing element (19,21,23,25). The folded dipole segments (22,24,26,28) are implemented on the front side of planar antenna 14, and the cross section of quadrature phase shifter 16 engaging with planar antenna 14 is also shown in FIG. 3. The length of each folded dipole segment (22,24,26,28) is approximately one quarter wavelength of the center frequency of the desired operating frequency range. The dimensions of planar antenna 14 may vary slightly depending on the dielectric constant of the PCB material that introduces minor delays in the antenna surface currents. For a 900 to 950 MHz frequency range, the dimensions are as shown in FIG. 2. For other operating frequency ranges the dimensions will vary in proportion to the operating frequency, and such dimensions would be smaller for the 2.4 GHz ISM band.

A cross section of the PCB intersection is shown in FIG. 3 wherein planar antenna microstrips 27 are preferably located on a single, front side of planar antenna 14 but may also be located on both sides of planar antenna 14 in other embodiments of the invention. Folded dipole segments (22,24,26,28) are preferably located on one side of a PCB as shown in FIG. 3, however pairs of dipoles could be alternately located on opposite sides of the PCB. The input impedance across each pair of antenna leads is twenty-five ohms in one embodiment of the invention. Because planar antenna 14 is mounted separately from other system electronics, a PCB can be made of less expensive material that does not support multi-layer PCB traces, further adding to design economy. Referring to FIG. 3, planar antenna PCB dielectric layer 31 is preferably made from phenolic material relatively inexpensive compared to other PCB dielectric materials. Associated with each folded dipole segment is a phasor passive radiator element or phasing element (19,21,23,25). Phasing elements (19,21,23,25) provide coupling between folded dipole segments (22,24,26,28), thereby combining fields from opposing dipole ends. This draws the electromagnetic fields together, contributing to the omnidirectional radiation field pattern of antenna 14.

Figure 4:
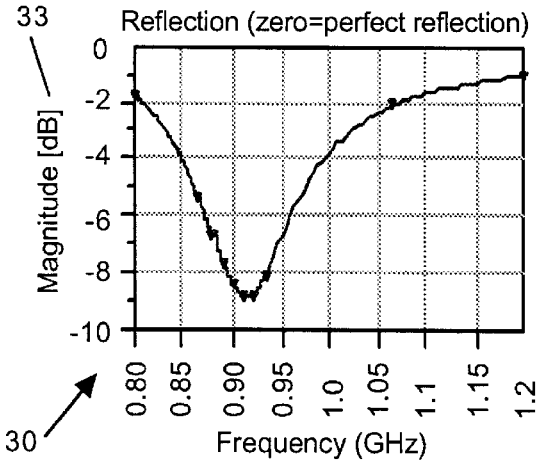
FIG. 4 illustrates the input network characteristics of the planar folded dipole antenna including reflection, phase shift and complex impedance in and around a representative operating frequency range of 900 to 950 MHz.
Figure 4:
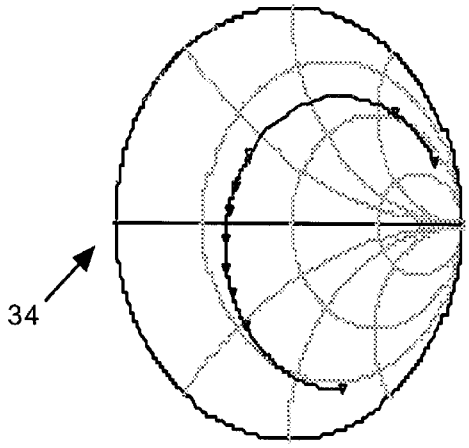
Figure 4:
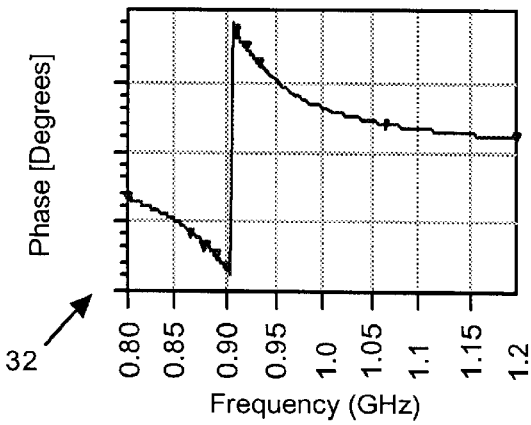

Referring to FIG. 4, planar antenna 14 has an input reflection response 30 and phase response 32 centered about or "tuned" to a desired frequency range. The magnitude 33 of the input reflection response indicates the degree to which a given frequency is reflected by antenna 14. For ideal power transfer no input signal is reflected. A magnitude value of zero indicates perfect reflection, whereas a lower value indicates less reflection and hence higher power transfer. Power transfer in the 900 to 950 MHz range is preferred. Smith chart 34 indicates complex impedance for the analyzed operating frequency range. The width of the desired operating frequency range is determined by the "Q" value of the antenna as known in the art. The higher the Q value, the greater the signal reflection or attenuation for off-operating-frequency-range signals and the narrower the operating frequency range. The specific physical configuration and dimensions of the metallic traces and the dielectric properties of the PCB material embodied in the invention all contribute to determining the Q value of the system. The preferred planar antenna 14 configuration and dimensions for the 900 to 950 MHz frequency range are shown in FIG. 2. Other frequency ranges of various sizes may be accommodated by changing the physical lengths of the metallic traces and potentially the dielectric of the PCB material chosen.

Figure 5:
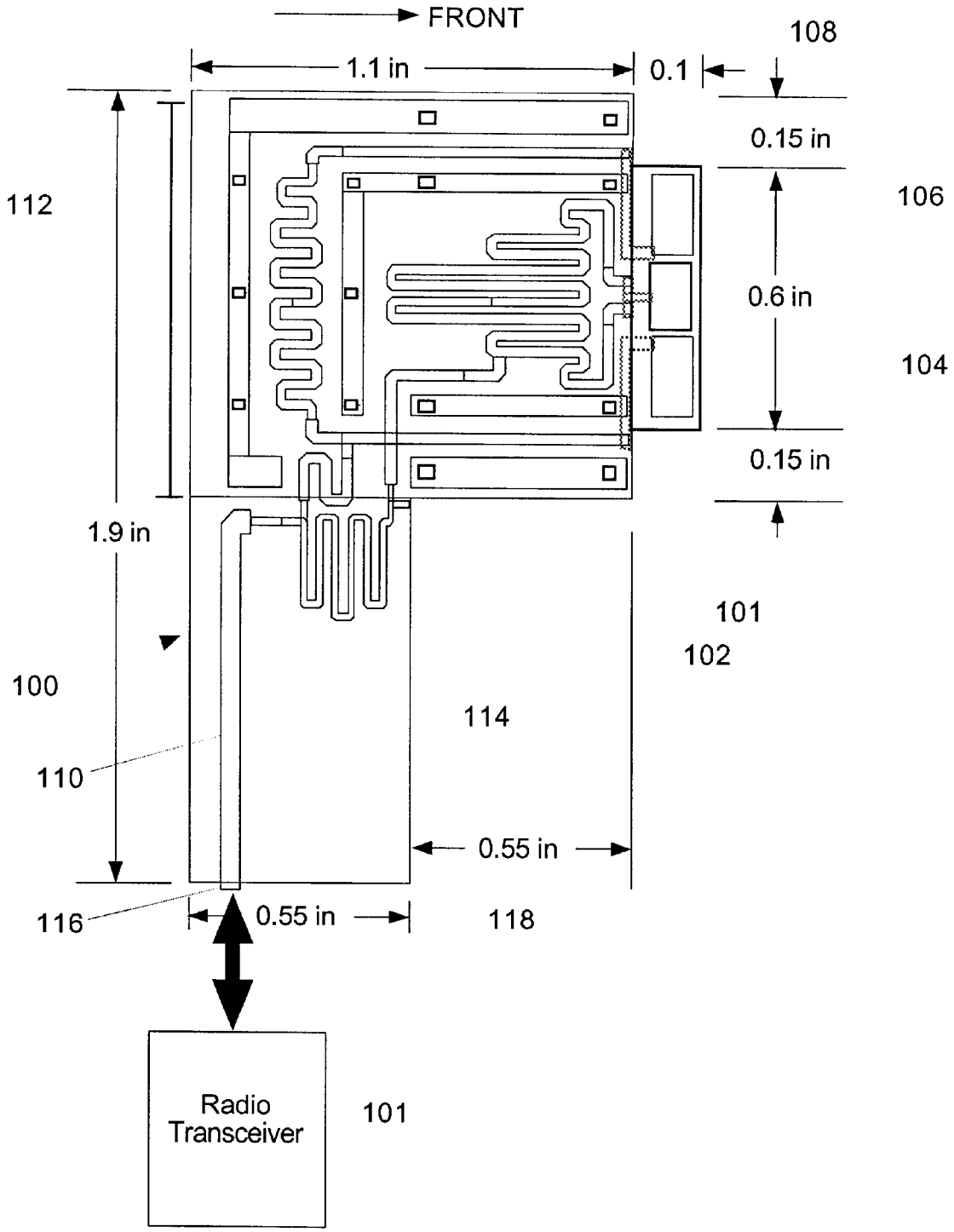
FIG. 5 illustrates a superposition of the layers of the quadrature phase shifter printed circuit board with overall dimensions.
Figure 6:
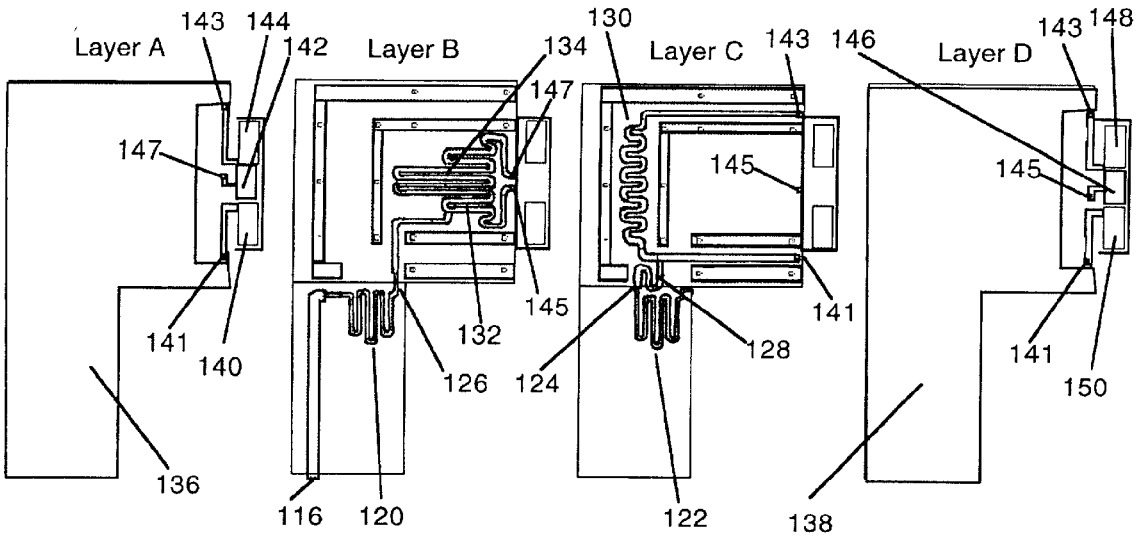
FIG. 6 illustrates a decomposition of the layers of the quadrature phase shifter printed circuit board.

FIG. 5 illustrates quadrature phase shifter circuit 100 as a superposition of multiple circuit board layers that enables the phase shifting function and optimal impedance matching between input and outputs to quadrature phase shifter circuit 100. Quadrature phase shifter circuit 100 has a "strip line" format in that the metallic traces for carrying signals are primarily sandwiched between metallic ground planes 136 and 138 as shown in FIG. 6. The input between the quadrature phase shifter circuit 100 and the radio transceiver 101 is shown as 116. Signals to and from the radio transceiver 101 pass through wave guide strip line 110. Ninety degree hybrid divider 114 in FIG. 5 is composed of layer two and layer three strip line curved sections 120 and 122 (FIG. 6, Layers B and C) sandwiched between metal ground planes 136 and 138 (FIG. 6, Layers A and D). Strip line curved sections 120 and 122 are not physically connected but are capacitively coupled. Hybrid divider 114 splits the signal from radio transceiver 101 evenly and introduces phase shift while introducing negligible power loss.

As shown in FIG. 6, on Layer C a zero degree phase shifted (relative to the input of 114), unbalanced output 124 from hybrid divider 114 enters transformer portion 112 section of quadrature phase shifter circuit 100. This signal passes through transformer element 128 and then transformer element 130 to produce output 102 and output 108 respectively (FIG. 5). Outputs 102 and 108 are balanced and 180 degrees out of phase with each other. Outputs 102 and 108 on Layer C are connected to connector pads 140 and 144 and pads 150 and 148 respectively on Layer A and Layer D by via's 141 and 143 that pass through all layers of the quadrature phase shifter circuit 100 PCB as shown in FIG. 6. These pads are used as solder points 29 (FIG. 3) to connect quadrature phase shifter circuit 100 PCB to the planar antenna 14 folded dipole segments (22,24). On Layer B as shown in FIG. 6, a 90 degree phase shifted (relative to the input of 114), unbalanced output 126 from the hybrid divider 114 enters the transformer 112 section of the quadrature phase shifter circuit 100. This signal passes through transformer element 132 and then transformer element 134 to produce output 104 and output 106 respectively (see FIG. 5). Outputs 104 and 106 are balanced and 180 degrees out of phase with each other. Outputs 102 to 108 are phase shifted from input 116. Outputs 104 and 106 on Layer B are connected to connector pads 146 and 142 respectively on Layer D and Layer A by via's 145 and 147 that pass through layers B,C,D and layers B and A of the quadrature phase shifter circuit 100 PCB as shown in FIG. 6. These pads are used as solder points 29 (see FIG. 3) to connect quadrature phase shifter circuit 100 PCB to the planar antenna 14 folded dipole segments (26,28). If output 102 is defined at being at an output phase reference of zero degrees, outputs 104, 106 and 108 are at relative phase angles of ninety, two hundred seventy and one hundred eighty degrees with respect to output 102. The zig-zag shape of folded strip line sections of transformer sections 128, 130, 132 and 134 contribute to the quadrature phase shifter circuit's 100 compactness. Quadrature phase shifter circuit 100 thus produces the signal that drives planar antenna 14 in a quadrature phase shifted fashion resulting in a circularly polarized output signal from planar antenna 14. Similarly horizontal and vertical polarized signals received by planar antenna 14 pass in the reverse direction and are combined into a composite signal which emerges from the output 116 before being fed to radio transceiver 101.

Due to the design configuration, the input and output impedance to quadrature phase shifter circuit 100 can be both fifty ohms. This impedance matching ensures optimal power transfer between planar antenna 14 and the radio frequency transceiver. The impedance value is a function of the physical dimensions and configuration of the system and is designed to be substantially at this value for the entire operating frequency range of antenna system 10.

Figure 7:
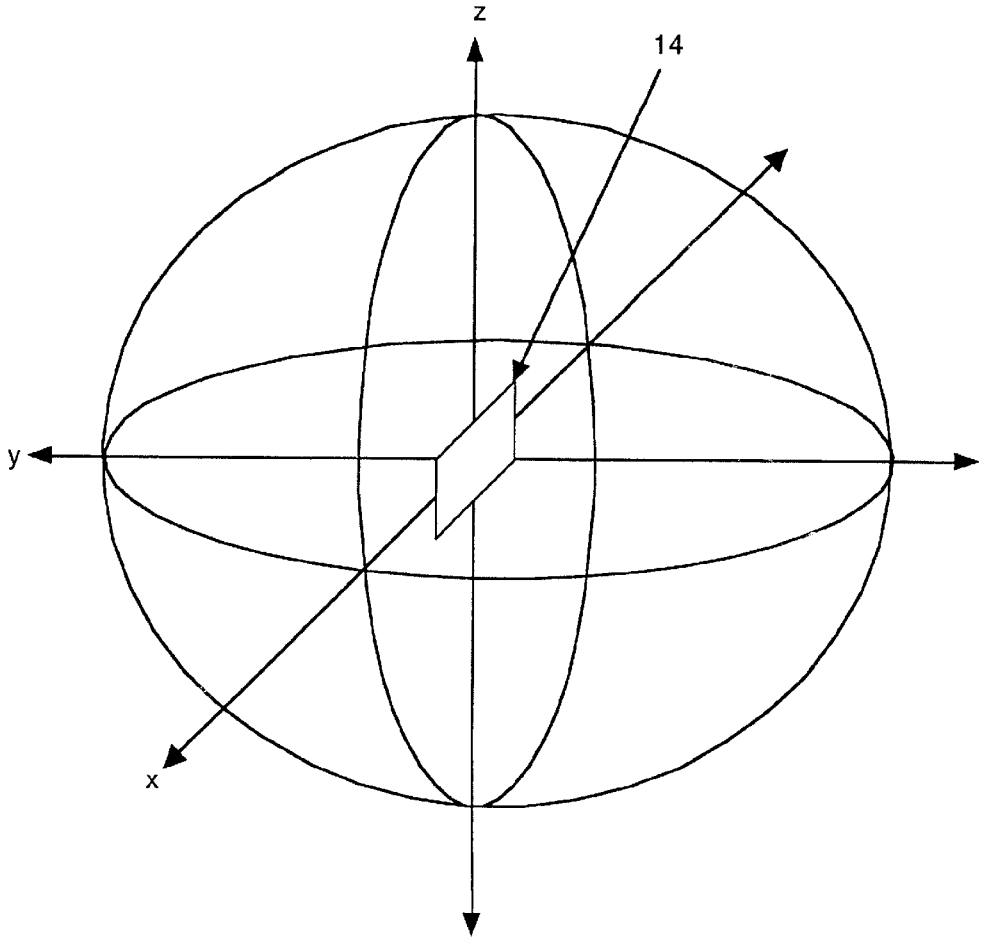
FIG. 7 illustrates the transmitted omni-directional electromagnetic field of the planar antenna.
Figure 8A:
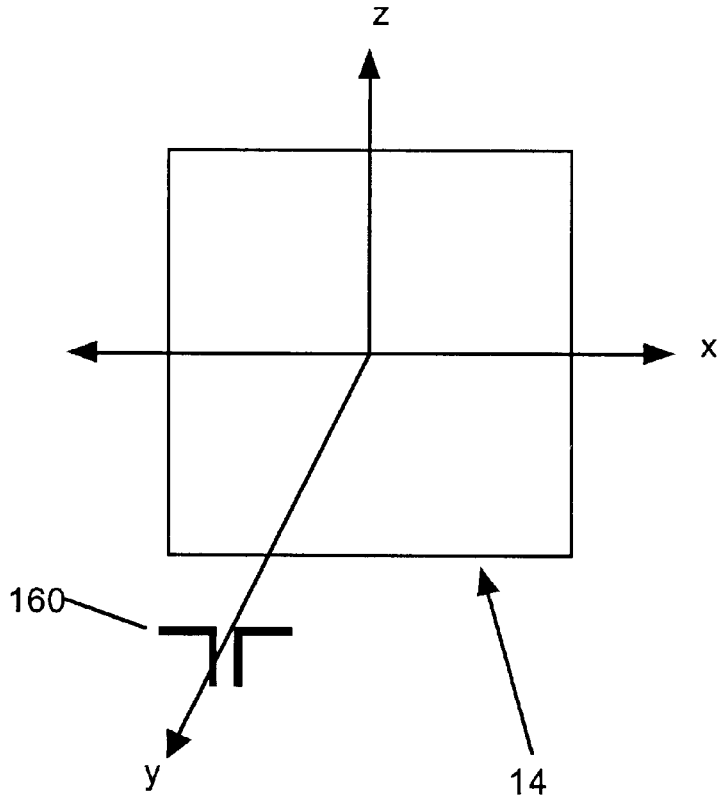
FIG. 8*a* illustrates a remote dipole antenna oriented parallel to the x-y plane.
Figure 8B:
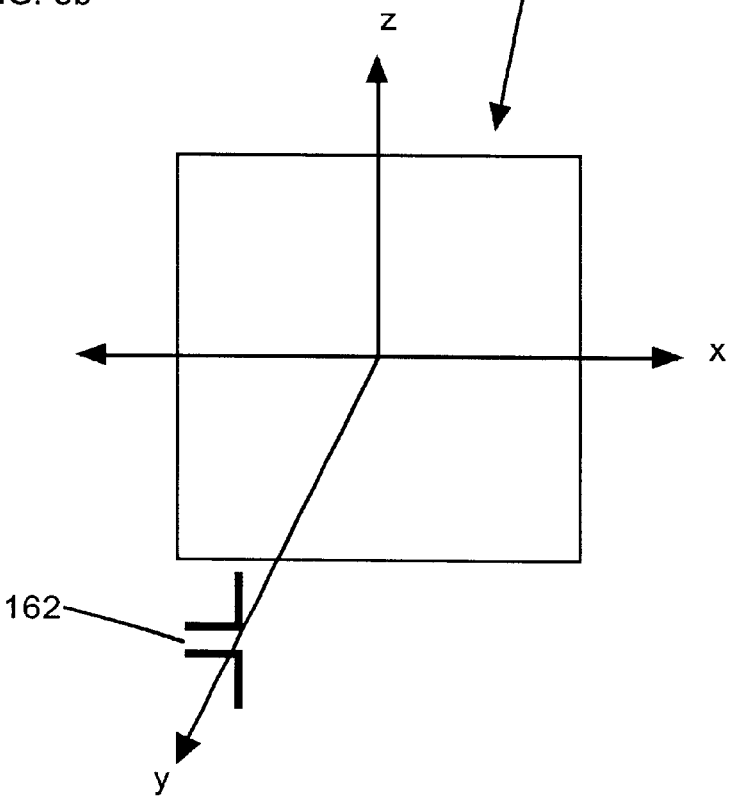
FIG. 8*b* illustrates a remote dipole antenna oriented perpendicularly to the x-y plane.
Figure 9:
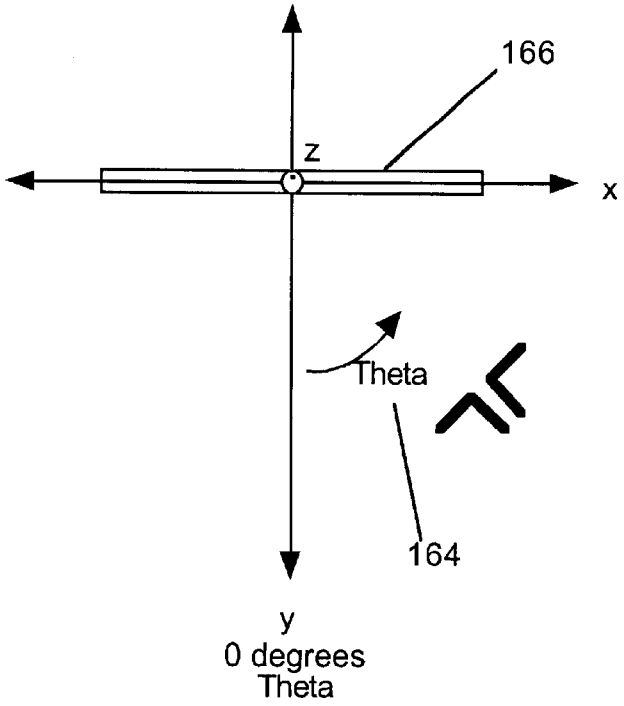
FIG. 9 illustrates a rotational angle theta as a remote dipole antenna moves in a radial path around the planar antenna in the x-y plane.

FIGS. 7 through 10 illustrate various attributes of the electromagnetic field for antenna system 10. Due to the quadrature nature of the system, planar antenna 14 has a transmit far electromagnetic field which is substantially omni-directional in nature as shown in FIG. 7. The receive capability of the planar antenna 14 is horizontally omni-directional in directions substantially perpendicular to its flat surface. FIGS. 8*a* and 8*b* show the planar antenna and a basic remote dipole antenna (160,162) typically located in a portable radio frequency device. While remote dipole antenna (160,162) is substantially in the x-y plane as shown in FIGS. 8*a* and 8*b*, planar antenna 14 receives the transmit signals from the remote dipole antenna (160,162) to planar antenna 14 equally well regardless of its rotational orientation. Two examples of such orientation are shown in FIG. 8*a* and FIG. 8*b* in 160 and 162 respectively. This is true since the sum of the induced voltages in planar antenna 14 as collected from its four dipole segments (22,24,26,28) and combined by quadrature phase shifter circuit 100 is essentially the same regardless of the rotational orientation of remote dipole antenna (160,162). FIG. 9 illustrates a top view of the same system with an angle theta 164 defined. When remote dipole antenna 160 is perpendicular to the flat surface of planar antenna 166, theta 164 is zero degrees (in front) or plus or minus one hundred eighty degrees (in back).

Figure 10:
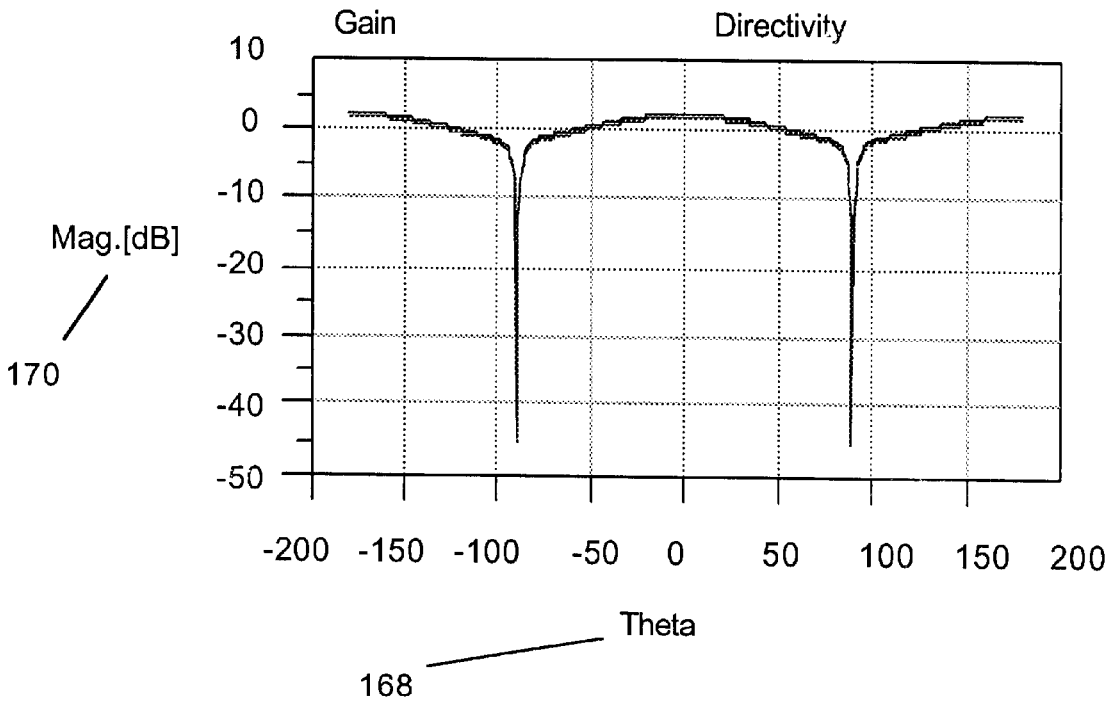
FIG. 10 illustrates a representative power plot of the received signal at the planar antenna from a remote dipole antenna.

FIG. 10 illustrates a representative receive power plot of planar antenna 14 as angle theta 164 is varied. Horizontal axis 168 shows theta 164 and vertical axis 170 shows the magnitude of the received power. When theta 164 is plus or minus ninety degrees from the positive y axis, the composite received power by antenna system 10 is at a minimum. This occurs since in this case remote dipole antenna 160 is located to the side of the thin edge of planar antenna 14. At almost all other angles in front or back of planar antenna 14 the power is essentially constant. Combining this attribute with the independence of signal strength regardless of the rotational orientation, the invention has substantial advantages. When a user is holding a device containing the remote dipole antenna 160, the user can be in numerous locations in front or back of planar antenna 14 in the x-y plane and regardless of the device rotational orientation, the received signal at planar antenna 14 from remote dipole antenna 160 is essentially the same.

Another embodiment of the invention may be constructed using any material upon which conductive strips are deposited and wherein multiple layers of said material with conductive inter-layer connections are laid upon each other. For example such a device or portions of such a device might be constructed upon layers of plastic or similar flexible film upon which conductive strips may be deposited or printed.

The invention provides an omni-directional, planar folded dipole antenna 14 and related quadrature phase shifter 16 implemented on PCBs having differing properties that are perpendicularly engaged. The planar antenna segment is implemented on a single-sided inexpensive PCB whereas quadrature phase shifter 16 and system electronics are implemented on more expensive multi-layer PCBs. The invention reduces cost and improves system reliability because coaxial or other connectors of varying material and installation quality are not required between planar antenna 14 and quadrature phase shifter 16. Planar antenna 14 transmits radio frequency signals in an omni-directional pattern and is capable of receiving signals from remote dipole antennas positioned in arbitrary physical orientations. Quadrature phase shifter 16 provides both phase shifting functions and also converts an unbalanced radio frequency transceiver output signal into a balanced input signal to planar antenna 14. The invention is preferably configured for use in low power, short range radio systems such as consumer electronics, gaming, computer and local area networking but can also be used for other applications where severe cost constraints require a highly integrated, effective and consistently reproducible antenna system design.

The invention provides a simple and effective two piece circularly polarized antenna system 10 consisting of an planar antenna 14 portion mounted in a vertical orientation and a quadrature phase shifter 16 which are implemented using printed circuit boards of differing properties and costs. The antenna system 10 produces a substantially omni-directional field using a reliably and consistently manufacturable design. Despite the simplicity of the design, a remote dipole antenna 160, connected to a radio transceiver sending and receiving radio frequency signals to the antenna system 10, may be configured in an arbitrary physical orientation. This greatly increases the utility because the end user does not have to be concerned about how the device is oriented or where the device is located to get optimal and reliable signal transmissions. The invention substantially provides antenna system efficiencies for extremely cost constrained radio frequency applications.

Although the invention has been described in terms of certain preferred embodiments, it will become apparent to those of ordinary skill in the art that modifications and improvements can be made to the ordinary scope of the invention concepts herein without departing from the scope of the invention. The embodiments shown herein are merely illustrative of the inventive concepts and should not be interpreted as limiting the scope of the invention.

What is claimed is:

1. A planar, omni-directional antenna system for use with printed circuit boards, comprising:

a planar antenna engaged with a first printed circuit board for radiating and receiving electromagnetic signals, wherein said antenna has four quarter wavelength, folded dipole sections organized in pairs;

at least one pair of phasor passive radiator elements associated with said folded dipole sections on the planar antenna;

a radio frequency transceiver;

a quadrature phase shifter circuit engaged with a second printed circuit board, wherein said quadruture phase shifter circuit comprises a phase shifting hybrid power divider and transformer connected to said planar antenna and said radio frequency transceiver; and at least one connector trace connecting said planar antenna, quadrature phase shifter and radio frequency transceiver.

2. A system as recited in claim 1 wherein the orientation of said system does not change the system ability to receive and transmit signals equally well to a remote dipole antenna.

3. A system as recited in claim 1, wherein said phasor passive radiator elements assist to shape the electromagnetic field into a substantially omni-directional pattern.

4. A system as recited in claim 1, wherein said quadrature phase shifter circuit is contained on the second printed circuit board mounted at right angles to said planar antenna where such second printed circuit board conducts and modifies the signals to and from said planar antenna.

5. A system as recited in claim 4, wherein said second printed circuit board is connected to a third printed circuit board that contains a radio transceiver and associated other electronic components.

6. A system as recited in claim 4, wherein said second printed circuit board houses said quadrature phase shifter circuit and also contains a radio transceiver and associated other electronic components.

7. A system as recited in claim 1, wherein said quadrature phase shifter circuit drives the four folded dipole sections of the planar antenna by phase shifting the radio transceiver input signal by zero, ninety, one hundred eighty and two hundred seventy degrees using a hybrid power divider and strip line transformer stages.

8. A system as recited in claim 7, wherein said quadrature phase shifter circuit is configured for a particular operating frequency range and has an input impedance for that operating frequency range that is matched to the input impedance of the radio frequency transceiver and balanced for the planar antenna.

9. A system as recited in claim 7, wherein said quadrature phase shifter hybrid power divider is composed of multilayer stripline segments capacitively coupled to produce multiple outputs having differing phase shift characteristics with low system loss.

10. A system as recited in claim 1, wherein such planar antenna is configured for a particular operating frequency range where such operating frequency range can be arbitrarily changed by adjusting the antenna dimensions while considering the dielectric properties of the printed circuit boards.

11. A system as recited in claim 1 which is constructed from non-PCB flexible material upon which conductive strips have been placed and through which interconnection points are connected.

* * * * *